US007946300B2

(12) United States Patent
Kim et al.

(10) Patent No.: US 7,946,300 B2
(45) Date of Patent: May 24, 2011

(54) RINSE WATER HEATING DEVICE FOR DISH WASHER

(76) Inventors: Jong-Deuk Kim, Kunpo-si (KR); Chun-Ho Yuk, Seoul (KR); Heun-Kam Lee, Maple Ridge, CA (US)

( * ) Notice: Subject to any disclaimer, the term of this patent is extended or adjusted under 35 U.S.C. 154(b) by 428 days.

(21) Appl. No.: 12/115,701

(22) Filed: May 6, 2008

(65) Prior Publication Data

US 2009/0277482 A1 Nov. 12, 2009

(51) Int. Cl.
*B08B 13/00* (2006.01)

(52) U.S. Cl. ..... 134/105

(58) Field of Classification Search ..... 134/105
See application file for complete search history.

(56) References Cited

U.S. PATENT DOCUMENTS 3,962,560 A * 6/1976 Braathen ..... 392/456
4,380,215 A * 4/1983 Mendelson ..... 122/17.2
4,692,592 A * 9/1987 Kale ..... 392/450
5,301,745 A * 4/1994 Seib et al. ..... 165/47
5,660,193 A * 8/1997 Archer et al. ..... 134/56 D
2006/0260656 A1* 11/2006 Berner et al. ..... 134/56 D

* cited by examiner

*Primary Examiner* — Michael Barr
*Assistant Examiner* — Samuel A Waldbaum
(74) *Attorney, Agent, or Firm* — Volpe and Koenig P.C.

(57) ABSTRACT

A rinse water heating device for a dish washer includes a water tank for storing a rinse water used for washing dishes, a rinse water tank divided from the water tank by a separation plate positioned at a lower portion of the water tank, partitions installed in the rinse water tank to form a rinse water guide path in a zigzag pattern, a heater installed along the rinse water guide path, and an inlet pipe installed to introduce water in the water tank into the rinse water tank. The water tank and the rinse water tank are divided from each other, so this device may subsequently heat a small amount of water in the rinse water tank within a short time. Therefore, the rinse water heating device allows an automatic dish washer to wash dishes with enhanced sterilizing, cleaning and drying abilities, thereby ensuring effective rinsing and washing.

3 Claims, 3 Drawing Sheets

RINSE WATER HEATING DEVICE FOR DISH WASHER

BACKGROUND OF THE INVENTION

1. Field of the Invention

The present invention relates to a heating device of a rinse water used in a dish washer for business use. More particularly, the present invention relates to a rinse water heating device for an automatic dish washer, which efficiently heats a rinse water in a rinse water tank to a high temperature by using a dual water tank.

2. Description of the Related Art

A conventional door-type automatic dish washer for business use primarily washes dishes for about 1 minute, and then secondarily washes, namely, rinses and sterilizes the dishes using a hot water of 90° C. or above for about 10 seconds. For the secondary rinsing, a heater is installed in an integrated water tank to heat water for rinsing.

This conventional method needs to simultaneously heat a large amount of water in a large water tank, so that its thermal efficiency is rather low. In addition, a temperature of water in a lower portion of the water tank is lower than that of an upper portion due to the convection of water since a water pump for a rinse water is installed at a low position on the ground level, and thus it pumps the water from the lower portion of the water tank with a relatively lower temperature. As a result, the temperature of rinse water is not high.

SUMMARY OF THE INVENTION

The present invention is designed to solve the problems of the prior art, and therefore it is an object of the present invention to provide a rinse water heating device for an automatic dish washer, which heats a rinse water for secondary rinsing to a high temperature efficiently by using a dual water tank, so that it may enhance a rinsing ability, a washing ability and a drying ability of the dish water and thus enhance the efficiency of the dish washer.

In order to accomplish the above object, the present invention provides a rinse water heating device for a dish washer, which includes a water tank for storing a rinse water used for washing dishes; a rinse water tank divided from the water tank by a separation plate positioned at a lower portion of the water tank; partitions installed in the rinse water tank to form a rinse water guide path in a zigzag pattern; a heater installed along the rinse water guide path; and an inlet pipe installed to let water in the water tank flow into the rinse water tank.

That is to say, in the present invention, the water tank located at an upper position is divided from the rinse water tank located at a lower position so that these tanks form a dual-type structure. Also, the rinse water tank is designed with a relatively smaller size than the water tank. A rinse water guide path is formed in the rinse water tank in a zigzag pattern. The rinse water in the lower tank with a relatively smaller capacity is heated to a high temperature within a short time by the heater installed along the rinse water guide path. While the water pump is operated for the secondary washing (during about 10 seconds), the check valve is closed, and the rinse water in the rinse water tank, heated to a high temperature, is pumped into the dish washer to rinse dishes. Water as much as an amount discharged through the water pump is supplemented into the rinse water tank through the inlet pipe. During the primary washing (for about 1 minute), the water in the rinse water tank is heated to a high temperature by the heater for the secondary washing.

BRIEF DESCRIPTION OF THE DRAWINGS

Other objects and aspects of the present invention will become apparent from the following description of embodiments with reference to the accompanying drawing in which.

Figure 1:
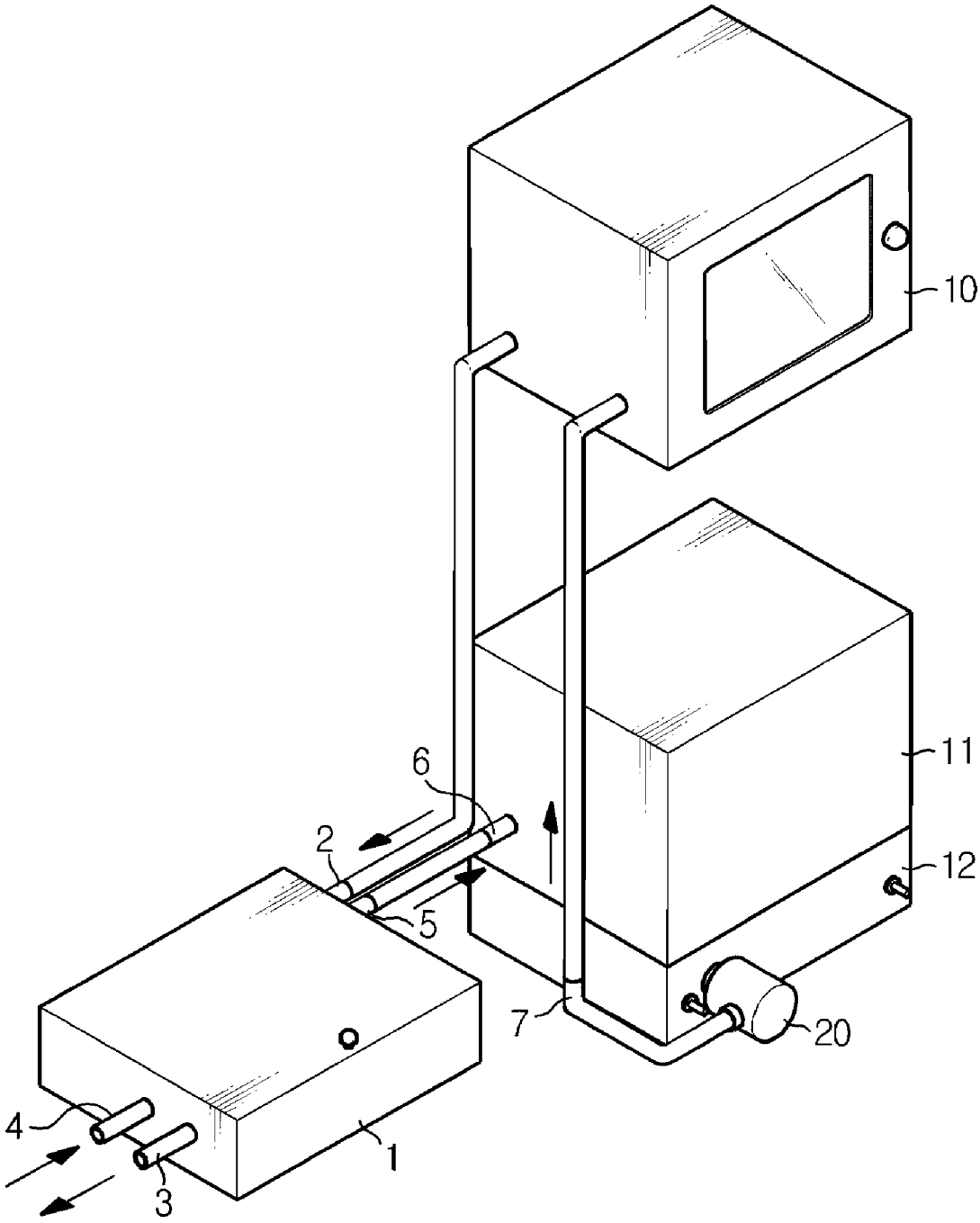
FIG. 1 is a schematic view showing a rinse water heating device according to an embodiment of the present invention.

<Reference Numerals of Essential Parts in the Drawings>

| | |
|---|---|
| 1: waste water recycling unit | 10: dish washer |
| 11: water tank | 12: rinse water tank |
| 13: separation plate | 14: inlet pipe |
| 15: check valve | 16: heater |
| 17: partition for guiding rinse water | 20: water pump |
| 34: preheating pipe | |

DESCRIPTION OF THE PREFERRED EMBODIMENT

Hereinafter, configuration and operation of a rinse water heating device according to an embodiment of the present invention will be described in detail with reference to the accompanying drawings.

Figure 2:
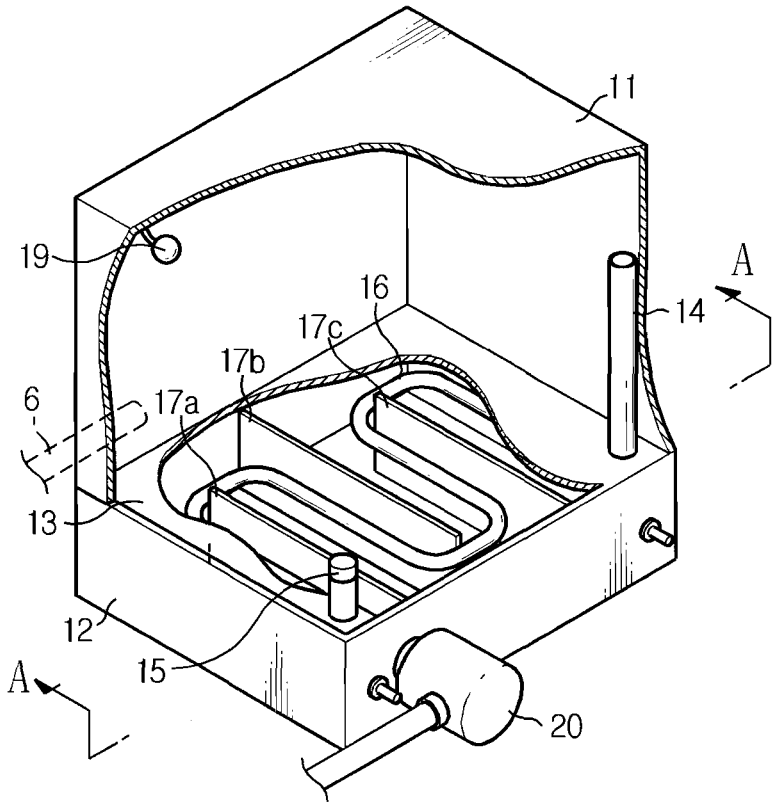
FIG. 2 is an exploded perspective view showing the rinse water heating device according to the embodiment of the present invention.
Figure 3:
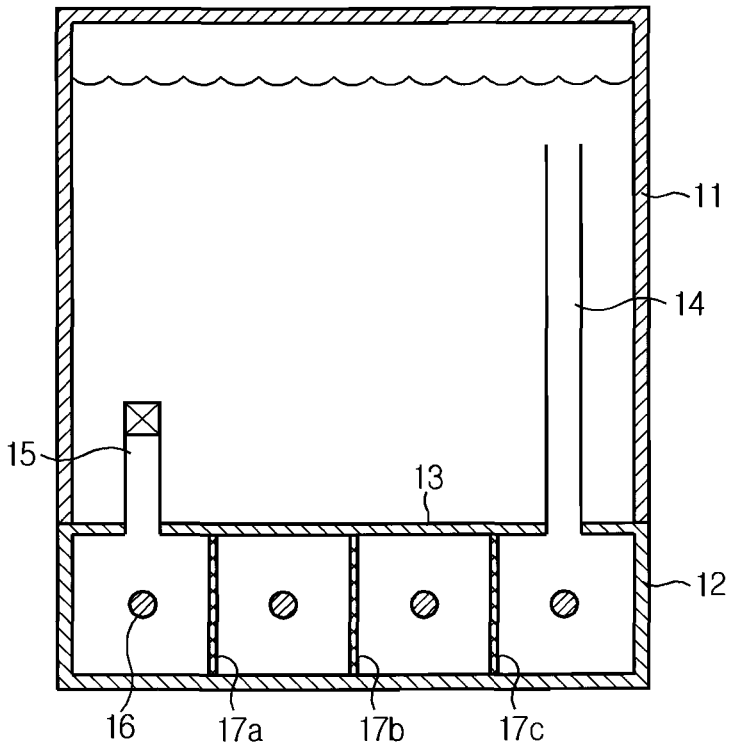
FIG. 3 is a sectional view taken along the line A-A of FIG. 2.

In FIG. 2, a water tank 11 is a tank for storing water that is used for washing dishes. A rinse water tank 12 is positioned below the water tank 11I with a relatively smaller size than the water tank 11. The rinse water tank 12 is divided from the water tank 11 by a separation plate 13. Partitions 17*a*, 17*b*, 17*c*, each having one side opened, are installed in the rinse water tank 12 in turns so as to guide the flow of rinse water in a zigzag pattern, and a heater 16 is installed along the rinse water guide path.

An inlet pipe 14 is installed to communicate the water tank 11 with the rinse water tank 12 through the separation plate 13. Thus, the water in the water tank 11 can flow into the rinse water tank 12 through the inlet pipe 14. The inlet pipe 14 is preferably installed to extend below the separation plate 13 such that vapor or hot water in an upper portion of the rinse water tank 12 does not flow up. Also, the inlet pipe 14 preferably extends up to an upper portion of the water tank 11 such that a water in the upper portion of the water tank 11 can flow into the rinse water tank 12. In addition, the inlet pipe 14 is preferably installed near a start point of the rinse water guide path in the rinse water tank 12 such that the rinse water may be sufficiently heated along the rinse water guide path by the heater 16.

In addition, a check valve 15 is installed near an end point of the rinse water guide path through the separation plate 13 such that a rinse water or vapor in the rinse water tank 12 may flow into the water tank 11. Thus, the check valve 15 plays not only a role of a safety valve but also a role of increasing the temperature of water in the water tank 11 while the dish washer does not wash dishes.

Figure 4:
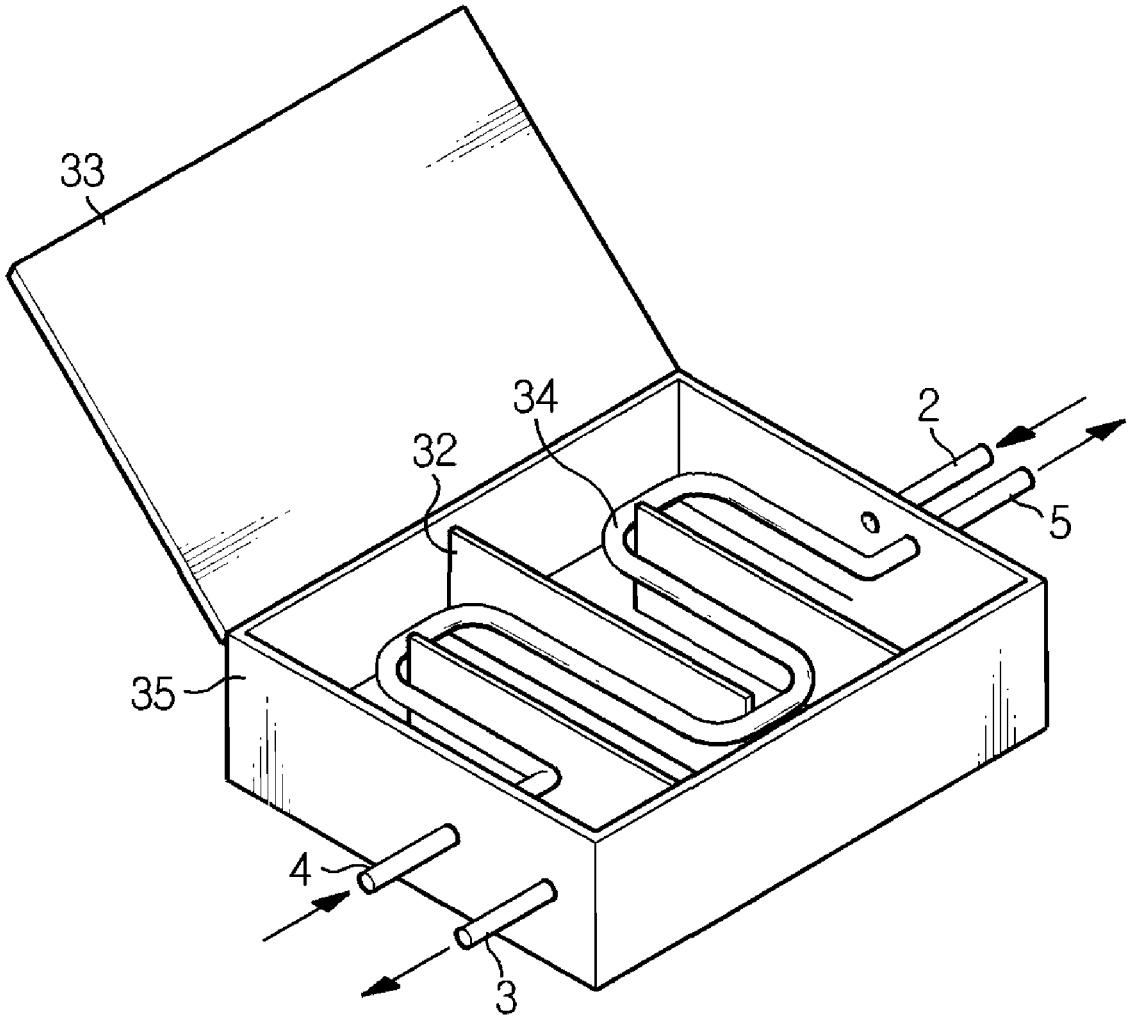
FIG. 4 is a schematic view showing a waste water recycling unit according to an embodiment of the present invention.

Meanwhile, a rinse water to be stored in the water tank 11 is preferably preheated using a waste water recycling unit 1 as shown in FIG. 4, for example. The waste water recycling unit 1 has a waste water inlet 2 through which waste water flows in, a waste water outlet 3 through which waste water flows out, partitions 32 respectively having one open end and installed in turns to guide waste water in a zigzag pattern, and a body 35 with a cover 33 capable of opening. A preheating pipe 34 is installed along a waste water guide path formed by these partitions 32.

The rinse water exchanges heat with waste water while flowing in the preheating pipe 34, so it is preheated. A flowing direction of waste water is set to be opposite to a flowing direction of rinse water, thereby enhancing a heat exchange efficiency. Meanwhile, the cover 33 installed to the body 35 of the waste water recycling unit 1 is used to allow easy cleaning of garbage or scale mixed in the waste water.

The rinse water heating device for a dish washer according to the present invention is operated as follows.

Generally, a dish washer for business use executes a primary washing for about 1 minute, and the dish washer executes a secondary washing, namely rinsing, at a high temperature for about 10 seconds. During the primary washing, the water in the water tank 11 is pumped into the dish washer by means of a pump (not shown) to wash dishes.

During the primary washing, the rinse water in the rinse water tank 12 is heated to a high temperature by the heater 16 for the secondary washing. After the primary washing is completed, the check valve 15 is closed and a water pump 20 is operated so that the secondary washing is executed at a high temperature. The rinse water in the rinse water tank 12 flows along the rinse water guide path formed among the partitions 17*a*, 17*b*, 17*c* toward an exit where the water pump 20 is positioned, and the rinse water is heated to a high temperature within a short time. In order to heat the rinse water to a high temperature, the rinse water tank 12 is preferably as large as double the amount of water discharged by the water pump 20 during the secondary washing. As shown in FIG. 1, the water pump 20 pumps a rinse water at a high temperature into a dish washer 10 through a pipe 7 and then secondarily washes, namely rinses, dishes. The water in the rinse water tank 12 successively flows from the water tank 11 through the inlet pipe 14.

Meanwhile, if the secondary washing is completed, a water temperature in the water tank 11 may be increased since the operation of the water pump 20 is stopped and the check valve 15 is opened such that hot water and vapor in the rinse water tank 12 may flow into the water tank 11. The water in the water tank 11 may be used for the primary washing. Waste water after washing dishes flows into the waste water recycling unit 1 through the waste water inlet 2, and discharged to the waste water outlet 3 through the waste water guide path formed among the partitions 32. The water flowing into an inlet 4, passing through the preheating pipe 34 and flowing out of an outlet 5 flows in an opposite direction to the waste water passing through the waste water guide path, and at this time the water is preheated while exchanging heat with the waste water. The preheated water flows into the water tank 11 up to a height of a floating sensor 19 through an inlet hole 6.

APPLICABILITY TO THE INDUSTRY

As explained above, the rinse water heating device of the present invention is configured such that the water tank and the rinse water tank are separated from each other, so it is possible to subsequently heat a small amount of water in the rinse water tank within a short time. Therefore, the rinse water heating device of the present invention allows an automatic dish washer to wash dishes with enhanced sterilizing, cleaning and drying abilities, thereby ensuring effective washing and rinsing.

The present invention has been described in detail. However, it should be understood that the detailed description and specific examples, while indicating preferred embodiments of the invention, are given by way of illustration only, since various changes and modifications within the spirit and scope of the invention will become apparent to those skilled in the art from this detailed description.

What is claimed is:

1. A rinse water heating device for a dish washer, comprising:

a water tank (11) for storing a rinse water;

a rinse water tank (12) divided from the water tank (11) by a separation plate (13) positioned at a lower portion of the water tank (11);

partitions (17*a*, 17*b*, 17*c*) installed in the rinse water tank (12) to form a rinse water guide path in a zigzag pattern;

a heater (16) installed in the rinse water tank;

an inlet pipe (14) installed to communicate an upper portion of the water tank (11) with a lower potion of the rinse water tank (12) through the separation plate (13) such that the rinse water in the upper portion of the water tank (11) flows into the rinse water tank (12) so as to be heated along the rinse water guide path by the heater (16) while a water pump (20) pumps the rinse water from the rinse water tank; and a check valve (15) installed through the separation plate (13) to allow a rinse water heated by the heater in the rinse water tank (12) to flow into the water tank (11) while the water pump (20) is not pumping the rinse water from the rinse water tank.

2. The rinse water heating device for a dish washer according to claim 1, wherein a waste water recycling unit (1) is installed at the front of the water tank (11), wherein the waste water recycling unit (1) includes a waste water inlet (2) through which waste water flows in, a waste water outlet (3) through which waste water flows out, partitions (32) for guiding waste water to flow in a zigzag pattern, and a body (35) with a cover (33) capable of opening, and wherein water to be introduced into the water tank (11) passes through a preheating pipe (34) installed in the waste water recycling unit (1) so as to exchange heat with the waste water already used for washing dishes.

3. The rinse water heating device for a dish washer according to claim 1, wherein the inlet pipe (14) is installed near a start point of the rinse water guide path, and the check valve (15) is installed near an end point of the rinse water guide path.

* * * * *